US006381853B1

(12) United States Patent
Parke

(10) Patent No.: US 6,381,853 B1
(45) Date of Patent: May 7, 2002

(54) ROTARY CUTTING DEVICE HAVING ADJUSTABLE TENSION

(76) Inventor: Terrence James Parke, 16 Cameron Ct., Toolern Downs, Melton VIC 3337 (AU)

( * ) Notice: Subject to any disclaimer, the term of this patent is extended or adjusted under 35 U.S.C. 154(b) by 0 days.

(21) Appl. No.: 09/381,693

(22) PCT Filed: Mar. 27, 1998

(86) PCT No.: PCT/AU98/00215

§ 371 Date: Jan. 3, 2000

§ 102(e) Date: Jan. 3, 2000

(87) PCT Pub. No.: WO98/43786

PCT Pub. Date: Oct. 8, 1998

(30) Foreign Application Priority Data

Mar. 27, 1997 (AU) ..... P05922

(51) Int. Cl.[7] ..... B26B 19/14
(52) U.S. Cl. ..... 30/207; 30/240; 30/206
(58) Field of Search ..... 30/205, 206, 207, 30/240

(56) References Cited

U.S. PATENT DOCUMENTS

| | | | | | |
|---|---|---|---|---|---|
| 45,821 | A | * | 1/1865 | Emery | 30/204 |
| 69,541 | A | * | 10/1867 | Clark et al. | 30/205 |
| 81,210 | A | * | 8/1868 | Reid | 30/205 |
| 82,673 | A | * | 10/1868 | Alwood | 30/205 |
| RE3,889 | E | * | 3/1870 | Wilder | 238/24 |
| 178,402 | A | * | 6/1876 | Brabson | 30/205 |
| 309,131 | A | * | 12/1884 | Carter | 30/207 |
| 376,233 | A | * | 1/1888 | Cameron | 30/206 |
| 616,214 | A | * | 12/1898 | Underwood | 30/138 |
| 625,405 | A | * | 5/1899 | Meacock et al. | 30/207 |
| 650,054 | A | * | 5/1900 | Silley et al. | 30/207 |
| 1,566,797 | A | * | 12/1925 | Holtzman | 30/132 |
| 1,582,324 | A | * | 4/1926 | Whitcomb | 30/207 |
| 1,633,063 | A | * | 6/1927 | Bernarducci | 30/202 |
| 1,648,931 | A | * | 11/1927 | Barry | 452/137 |
| 2,883,746 | A | * | 4/1959 | Gilsi | 30/205 |
| 3,945,116 | A | * | 3/1976 | Hardin, Jr. | 30/206 |
| 4,037,323 | A | * | 7/1977 | Seibold | 30/206 |
| 4,267,686 | A | * | 5/1981 | Heath | 30/347 |
| 4,601,103 | A | * | 7/1986 | Sugiyama | 30/307 |
| 4,631,826 | A | * | 12/1986 | Parke | 30/207 |
| 5,063,673 | A | * | 11/1991 | Webster | 30/276 |
| 5,329,702 | A | | 7/1994 | Uchiyama et al. | 30/346.51 |

FOREIGN PATENT DOCUMENTS

| | | |
|---|---|---|
| AU | 77462/81 A | 4/1983 |
| GB | 255398 | 7/1926 |
| GB | 1 246 284 | 9/1971 |
| GB | 2 147 843 A | 5/1985 |

* cited by examiner

*Primary Examiner*—M. Rachuba
*Assistant Examiner*—Kim Ngol Tran
(74) *Attorney, Agent, or Firm*—Burr & Brown

(57) ABSTRACT

A tensioning means for a rotary handpiece is described in which the handpiece (2) is characterized in having a planar rotating blade (12) provided with a plurality of teeth and a plurality of cutting elements (22) capable of moving reciprocally in a linear direction in response to contact by the teeth of the rotary blade (12) when it rotates. There is a clearance gap between the rotary blade and the cutting chips, the size of which is varied by movement of the tensioning means so that the cutting characteristics of the handpiece are changed in accordance with movement of the tensioning means which applies tension to the rotary blade. In one form, the tensioning means comprises a rotating spindle, a flanged member, a bearing member and a resilient means such as an O-ring located between the flanged member and bearing member.

25 Claims, 3 Drawing Sheets

ROTARY CUTTING DEVICE HAVING ADJUSTABLE TENSION

The present invention relates to a rotary cutting device in general, and to a rotary handpiece having a rotating blade or similar for cutting a variety of materials in particular. More particularly, the present invention relates to a hand held cutting device for use in the cutting and shearing industries, such as for example for shearing hair, fur, wool or the like from animals or humans, or for cutting other natural or synthetic materials such as metals, paper, textiles, fibres and the like. The handpiece is provided with a rotary cutting member in the for of a planar blade and a plurality of cutting elements in the form of elongate chips or blades which co-operate with the rotating blade so that material such as wool fibres or the like when located between the rotating planar blade and the chips is cut or severed. Even more particularly, the present invention relates to improvements in the handpiece by providing the handpiece with an adjustable tensioning means for adjusting the tension of the rotary cutting assembly, particularly the tension applied to the rotary planar blade in order to alter the cutting characteristics of the handpiece.

Although the present invention will be described with particular reference to a rotary handpiece for shearing sheep, in which the rotary handpiece has a cutting assembly comprising a planar rotating cutting member, a replaceable cartridge containing a plurality of cutting elements or chips and a means for adjusting the tension of the rotary cutting assembly, it is to be noted that the scope of the present invention is not limited to the described arrangement or embodiment but rather the scope of the invention is more extensive so as to include other arrangements of the rotary handpiece and uses for the rotary handpiece in other applications than those specifically described and to the use of the rotary handpiece for cutting a wide variety of diverse materials.

Additionally, it is to be noted that although the invention will be described with particular reference to a hand held headpiece, the present invention also applies to other forms of the handpiece having the cutting assembly, such as, for example, a robotically controlled handpiece having different forms of the cutting assembly, handpieces and cutting assemblies located at the end of a mechanical arm or similar, cutting assemblies provided with automatic shearing machines, and the like.

Currently, shearers almost universally use handpieces of the reciprocating or oscillating type, which have a fixed comb and a moveable cutter held in intimate contact with each other by a strong compressive force between the two. As the cutter reciprocates or oscillates in intimate contact with the fixed comb, material located between the cutter and comb is cut. However, as the cutter and comb must be held together with such force, heat due to friction between the two components is produced. This unwanted production of heat is undesirable.

Other disadvantages of conventional handpieces are caused by the cutter mechanism itself and the arrangement of the various components. The limitations of the reciprocal or oscillating motion are well known and include the problems of the cutter producing vibrations within the handpiece as it oscillates; heat build up due to frictional forces; the cutters and combs requiring regular replacement or sharpening; the need to provide sufficient lubrication; injury to and burning of the sheep and on occasions, the shearer; and, should the handpiece be dropped or knocked from the shearer's hand it can often continue operating in an out-of-control manner which is extremely dangerous for persons or animals in close proximity to the handpiece and may result in damage to the handpiece. In these cases the handpiece must be disconnected from its driving means before it can be approached and ultimately retrieved.

Efforts have been made in recent times to provide a handpiece having vibration characteristics which are less likely to cause injury and which are safer to use than conventional handpieces; which can operate at a lower temperature; which require no or little lubrication; and which are less likely to cause injury to shearers, shed personnel and to the sheep. Australian provisional patent application No. PN0883 amongst other applications describes a rotary handpiece which contributes significantly to overcoming the problems associated with the oscillating handpieces of the prior art. The rotary handpieces of Australian provisional patent application No. PN0883 have blades and chips which have a longer useful working life than those know previously, are relatively cheaper to maintain and are of such low cost that they maybe discarded when blunt and no longer serviceable and replaced by new blades or other cutters so that resharpening of the blades is not required. The rotary handpiece can be Mastered quickly even by novices. Co-pending Australian provisional patent application by the same applicant provides a rotary handpiece which comprises a rotary cutting member and a replaceable cartridge comprising a plurality of replaceable cutting elements or chips which co-operate with the rotary cutting member to sever material such as wool. The cartridge can be quickly and easily replaced as the chips become blunt and/or damaged and/or lost.

While these rotary handpieces provide important and useful advances over the cutting devices of the prior art, it has not hitherto before been possible to easily and quickly modify the action of the rotary cutting member in relation to the cutting elements to allow for use of the rotary handpiece to cut a wide variety of different types of materials requiring different cutting characteristics For example a shearer may want to modify or adjust the action of the rotary cutting member with respect to the cutting elements to allow for the different physical properties of different classes of wool or other materials using the one handpiece, such as, for example, to accommodate different grades of fineness of the wool, say from very fine to very coarse, and wool of different conditions, such as wool full of contaminants such as dirt particles, grass seeds, burrs and the like. Additionally, the handpiece may be used on cattle to shear hair from a cut line to clean the cut line of debris before the cattle is slaughtered in an abattoir. Thus, there is a need to be able to alter the cutting characteristics of a handpiece so that the one handpiece can be used to cut a wider variety of different and diverse materials, such as for example the range of different wool fibres and types of the various species of sheep and the hair or fur of other animals such as cattle, goats and the like. It has now been found that a rotary handpiece can be provided which allows the user to modify the cutting characteristics of the rotary cutting member and/or cutting element(s) quickly and easily by altering the tension of the rotary cutting assembly, particularly the tension applied to the rotary cutting member.

Thus, it is an aim of the present invention to provide a rotary handpiece provided with means for modifying the cutting characteristics of the handpiece, such as for example by providing the handpiece with an adjustable tensioning means for altering the tension applied between the rotating blade and the individual elongate cutters in order to accommodate a wider variety of different materials and/or different grades or thicknesses of the one material.

According to the present invention there is provided a rotary handpiece suitable for cutting or severing a material comprising:

a cutting member capable of rotary motion in a first direction, and at least one cutting element capable of substantially linear movement in a second direction, said motion in the first direction being different to the direction of movement in the second direction, and an adjustable tensioning means, wherein the cutting member and the cutting element are arranged such that the cutting member and cutting element co-operatively interact with each other in use to cut material located therebetween and wherein tension applied to the-cutting member can be adjusted by the adjustable tensioning means to alter the clearance of and the amount of contact between the cutting member and the cutting element in order to alter the cutting characteristics of the handpiece.

Typically, there is a plurality of substantially similar cutting elements, preferably elongate, grooved cutting chips having angularly inclined faces. More typically, the plurality of cutting elements are individually mounted on within a cartridge. Even more typically, the cartridge is a replaceable cartridge. Even more typically, the replaceable cartridge comprises a body portion having a plurality of recesses in which each recess is adapted to receive individual elongate cutting elements so that at least one angularly inclined cutting surface is exposed for contact With the cutting member. Even more typically, the cutting elements are individual cutting chips which can readily be replaced by new chips when worn, blunt or damaged.

Typically, the replaceable cartridge is provided with a body portion and forwardly directed projections. Typically, the recesses in the cartridge are located such that when a cutting element is located in the recess, the cutting element extends in the direction of the projection, that is, radially outwardly directed from the curved body portion. Typically, the cutting elements are removably held within the recesses by interference fit, a keyway, a positive retention means, a spring or biasing means, or the like. Typically, the cutting elements are readily replaceable so that should a cutting element become broken or damaged, it may be easily removed, such as for example by being levered out of the recess using a suitable implement such as a fingernail or similar tool, and discarded before being replaced with a new cutting element. If several cutting elements need replacing simultaneously, the cartridge may be removed from the handpiece and discarded and a new cartridge containing a fresh set of cutting elements inserted in the handpiece.

Typically, the rotary handpiece comprises a handle, a hub, a body portion and a guide means. The guide means typically comprises a plurality of narrow, elongate fingers which form a comb for guiding the rotary handpiece along a predetermined pathway through the material being cut, such as for example wool, fur, hair or the like. Typically, the guide means is integral with the body portion. Typically, the cutting member and the cartridge are removably mounted or connected to the body of the rotary handpiece. More typically, the fingers direct material to be cut towards the cutting member and cutting chips to effect cutting of the material in use of the handpiece.

Typically, the cutting member is a substantially planar rotary blade, such as, for example, in the form of a rotatable disc having a plurality of generally radially directed cutting surfaces in the form of teeth. More typically, each individual tooth is generally arcuate in which at least one of the leading edge or the trailing edge of the tooth is curved, preferably both trailing and leading edges being arcuate. More typically, each tooth has a leading edge and a trailing edge shaped so that the teeth are swept back with respect to the normal direction of rotation of the blade in use. Even more typically, the teeth are radially arcuately curved. Even more typically, both the leading and trailing edges of the teeth are curved in the same direction. Typically, the rotary blade is resiliently mounted or connected to the handpiece by a mounting means or connection means in such a manner so as to permit rotary movement of the cutting member with respect to the body of the rotary handpiece and the mounting means or connection means. Typically, the rotation of the rotary blade causes individual teeth of the rotary blade to contact individual chips in turn to move the chips linearly backwards in use of the handpiece to cut material located between the blade and the cutting element.

Typically, the tension on the rotary blade is applied by a tensioning means. More typically, the tensioning means includes a blade retainer plate. More typically, movement of the blade retainer plate alters the degree of tension applied. Even more typically, the blade retainer plate is rotatable to adjust the tension. More typically, the tension on the rotary blade is readily adjusted using a spanner or other tool to rotate the blade retainer plate, or the blade retainer plate is manually adjustable. Typically, the rotary blade is connected to a hub axle by the blade retainer plate which is provided with a centrally located externally threaded boss which is threadingly received into a correspondingly threaded internal bore located at the end of a spindle, which in turn screws into the hub axle, thus allowing rotary motion of the spindle and all the components connected thereto, including the rotary blade.

Typically, the tension on the rot blade can be adjusted using an adjustment means comprising the espindle, a flanged ember and a bearing provided with a resilient element. Typically, the resilient element is located between the flanged member and the bearing. Typically, as the blade retainer plate is screwed into the end of the spindle, the distal and surface of the spindle end bears down on the flanged member which concomitantly compresses the resilient element against the bearing. More typically, the resilient element is an O-ring or similar. The use of an O-ring or the like provides a flexible or resilient body against which the tension on the cutting member may be adjusted.

Typically, the tension on the cutting member cay be continuously adjusted, i.e. stoplessly between the limits, or alternatively the adjustment of the tension on the cutting member may be incremental, i.e. Stepwisely using a ratchet mechanism or similar to adjust the tension by a preselected amount each time. Preferably the ratchet mechanism or the like incorporates detents or audible "clicks" so that the user can better measure or judge the amount of increase or decrease in tension to be applied to the rotary blade as the blade retainer plate is screwed into or out of the spindle.

Typically, the cartridge comprises a biasing means. In use the biasing means provides bias between the cartridge and the body of the rotary handpiece. Typically, the biasing means, comprises a piece of resilient material such as rubber or plastics or polymeric material, particularly plastic or polymeric tubing. Typically, the biasing means is held by interference fit in an elongate depression in the body of the cartridge. It will be readily appreciated by those skilled in the art that different biasing forces can be achieved by using materials of different resiliency. Typically, the biasing means comprises a piece of polymer tubing such as surgical tubing located in a shallow, curved depression in thee body portion of the replaceable cartridge.

Typically, where the cartridge comprises a biasing means the biasing means acts to bias or retain the cutting elements in the recesses of the body portion. More typically, where the cutting elements comprise triangular prism like shaped chips, one apex of the chips is in contact with the biasing means and the biasing means acts to retain the prism in the recess in the body portion.

Typically, the elongate cutting element or chip used in the handpiece of tile present invention is generally triangular prism shaped blade or chip. More typically, the cutting element is arranged so that in the normal in use position of the cutting device the base of the triangular blade or chip is oriented towards the cutting surfaces of the rotary blade. More typically, the cutting element is provided with a cutting surface which is in contact with the cutting surface of the teeth of the rotary blade.

Typically, where the cutting element is a triangular prism like shaped chip, the chip is provided with a number of surfaces which are parallel to each other. More typically, all but one of the surfaces are parallel. Most typically, the surface which is not parallel to the other surfaces is a tapering surface or an oblique surface arranged to extend at an acute angle to the parallel surfaces.

The cutting elements such as chips may comprise any convenient material and be manufactured by any convenient means. For example the cutting elements may comprise metal or synthetic material such as plastics or polymers, or may comprise a mixture of components such as polymer coated metal. The cutting elements may for example, be manufactured by cutting metal rod, bent sheet metal, metal pipe or the like.

The rotary handpiece of the present invention may be operated by any suitable means or method known in the art. One typical method of operation is described in Australian provisional patent specification No. PN0833. Typically, a drive shaft is rotated by suitable driving means which in turn rotates pinion and meshed gear thus turning an axle hub which causes the cutting means to rotate.

The present invention will now be described by way of example with reference the accompanying drawings in which.

Figure 1:
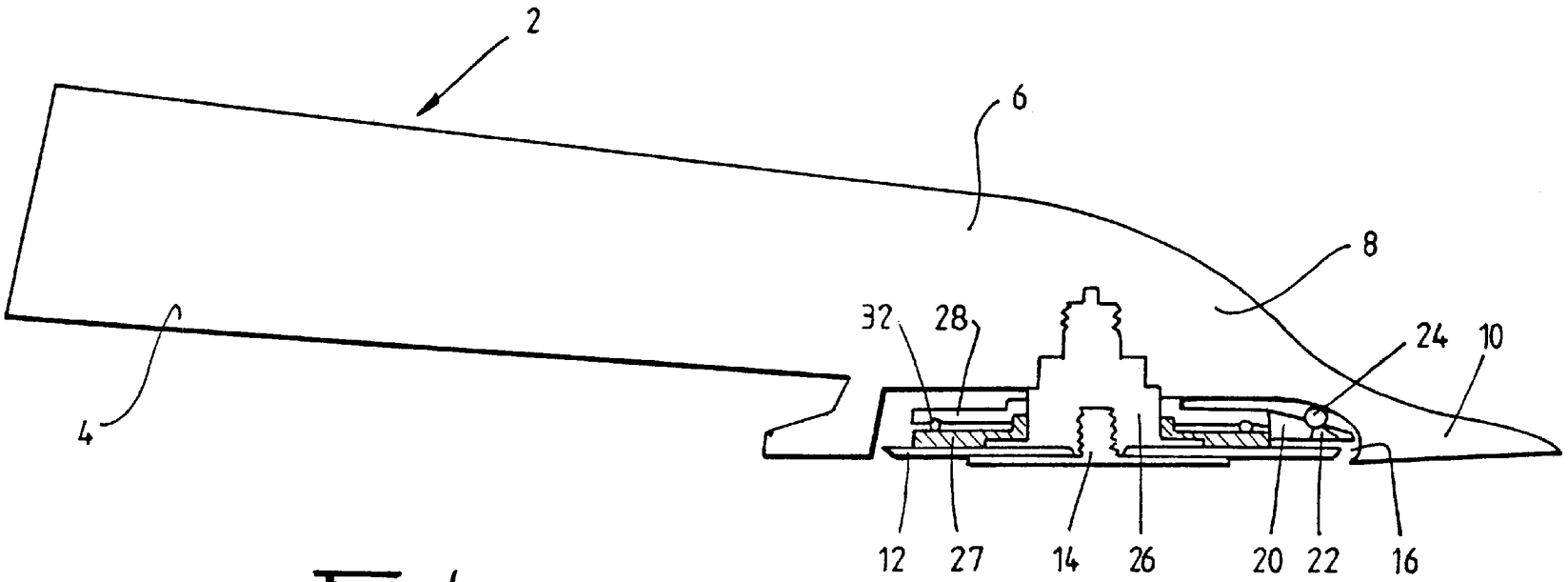
FIG. 1 is a vertical cross-sectional view of one form of the rotary handpiece of the present invention.

FIG. 1 shows a rotary handpiece, generally denoted as 2. The rotary handpiece comprises a rear portion which acts as a handle 4 so that the handpiece can be held in the hand of a user. Alternatively, handle 4 may be adapted for fitting to an arm of an automated shearing machine or similar. The rearmost part of the handle is fitted with an adaptor to allow it to be driven by any suitable driving means, such as a driving shaft, electric motor or similar. Alternatively, the rear of the handle 4 is adapted to be driven by a suitable driving means of an automatic shearing apparatus. Even further, handle 4 may be provided with an air motor driven by compressed air or similar gas.

The forward portion of the rotary headpiece comprises hub 6 and a body 8 which comprises an integral guide means in the form of a comb having multiple forwardly directed fingers 10. The cutting assembly is located in a cavity positioned on the underside of the body 8. It is to be noted that the use of terms describing the orientation of the rotary handpiece such as rear, forward, underside and the like refer to the rotary handpiece when in its normal in use position as shown in FIG. 1. This orientation and description is not meant to be limiting of the scope of the present invention. The hub and rear portion of the rotary handpiece enclose the drive mechanism (not shown) which is connected to the cutting assembly to rotate the cutting member in the form of a rotary blade in use. Typically, the drive mechanism is of the type described in respect of FIG. 1 of co-pending Australian patent application No. PN0833. Cutting member 12 is in the form of a substantially planar rotary blade connected to a hub axle (not shown) by a blade retainer plate 14. Blade retainer plate 14 is provided with a centrally located externally threaded boss which is threadingly received in a correspondingly threaded internal bore of a spindle located within an internal bore provided in the hub axle. The blade retainer plate is tightened to the hub axle to apply tension to the rotary blade 12.

The body 8 of the rotary handpiece comprises a generally rounded front body portion and a guide means comprising plurality of forwardly directed projections or fingers arranged in substantially parallel relationship to each other. The projections form the fingers of the comb and point in a direction which corresponds to the forward direction of move et of the rotary handpiece when in normal use. A recess 16 is located at or towards the rear of each finger for receiving corresponding projections of a replaceable cartridge 20. The cartridge 20 comprises a plurality of cutting elements 22 in the form of chips, preferably grooved, V-shaped, elongate cutting chips, each cutting chip being located rearwardly and generally between each pair of adjacent fingers of the comb, as shown more clearly in FIG. 3, The cutting elements 22 are located such that one face or edge of the cutting element is located adjacent the cutting surface of rotary blade 12 as it rotates, preferably the cutting surfaces of the teeth provided at regularly spaced apart locations around the circumference of the blade. The cartridge is held in place by a flange on the body (not shown) and is biased to bear against the body by a flexible polymeric tubing 24. In use, as rotary blade 12 rotates, the cutting elements are caused to move reciprocally along their longitudinal axes.

The adjustment means for adjusting the tension of the cutting assembly, particularly the rotating blade 12, comprises a centrally located spindle 26, a flanged member 27, a bearing 28 and an O-ring located between one surface of the flanged member 27 and the bearing 28.

The spindle 26 screws into the hub 6 by means of external thread 38 in such a manner as to allow spindle 26 to rotate in use when driven by the driving means located in the handle of the headpiece. As the spindle 26 turns, the cutting member 12 is caused to rotate correspondingly since the cutting member is connected to the spindle by the lower in use surface of the spindle being provided with engagement means (not shown) in t form of an opposed pair of flats of unequal length and being oppositely inclined to each other to engage with a complementary shaped aperture centrally provided in the rotary blade. As the blade retainer plate 14 is screwed into the spindle, the pressure on the blade 12 is increased which in turn applies pressure on the outwardly directed surface of flange 27 and the member mounted on the spindle on the opposite side of blade 12, causing the flanged member 27 to compress the O-ring 32 of the bearing 28. As the O-ring 32 is compressed the clearance between the cutting elements 22 and the blade 12 decreases. The smaller the clearance between the blade 12 and the cutting elements 22, the finer the wool, hair or other material which can be cut effectively and efficiently using the rotary handpiece. Therefore if fine-woolled sheep such as pure-bred merino sheep are being shorn the adjustment means is almost fully adjusted to provide maximum tension and accordingly minimum clearance to allow this fine wool to be cut. When shearing more coarse woolled varieties the adjustment is reduced to allow a greater clearance between the blade 12 and the cutting chips 22 to accommodate the coarser fibres of wool.

Figure 2:
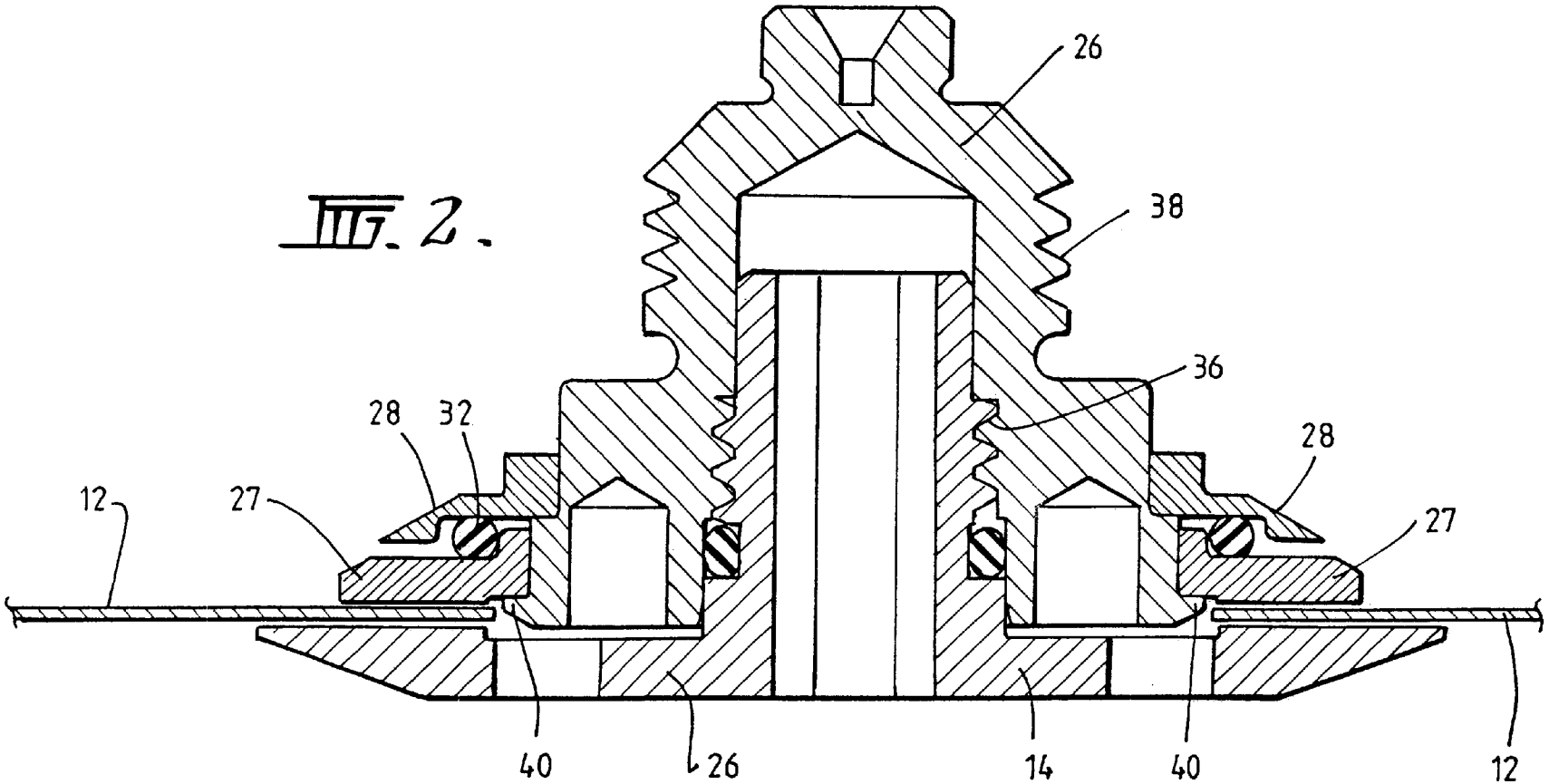
FIG. 2 is an enlarged vertical cross-sectional view of one form of the adjustment means for adjusting the tension on the cutting member of the handpiece of the present invention.

FIG. 2 is a cross-sectional view of the adjustment means shown in the rotary handpiece of FIG. 1. FIG. 2 shows the spindle 26 having a threaded internal bore 36 atone end (the distal end) while the other end of the spindle comprises an externally threaded boss 38. The externally threaded boss 38 may be threadingly received into the hub axle (not shown) of the handpiece. The blade retainer plate 14 may be threadingly received into the threaded internal bore 36 as shown. The entry to the threaded internal bore 36 is encircled by a flange 40. The flange bears on the flanged member 27 which in turn bears upon the O-ring 32 in the bearing member 28 so that by tightening blade retainer plate 14 the tension an the cutting assembly can be increased, thereby allowing for finer material to be cut.

Figure 3:
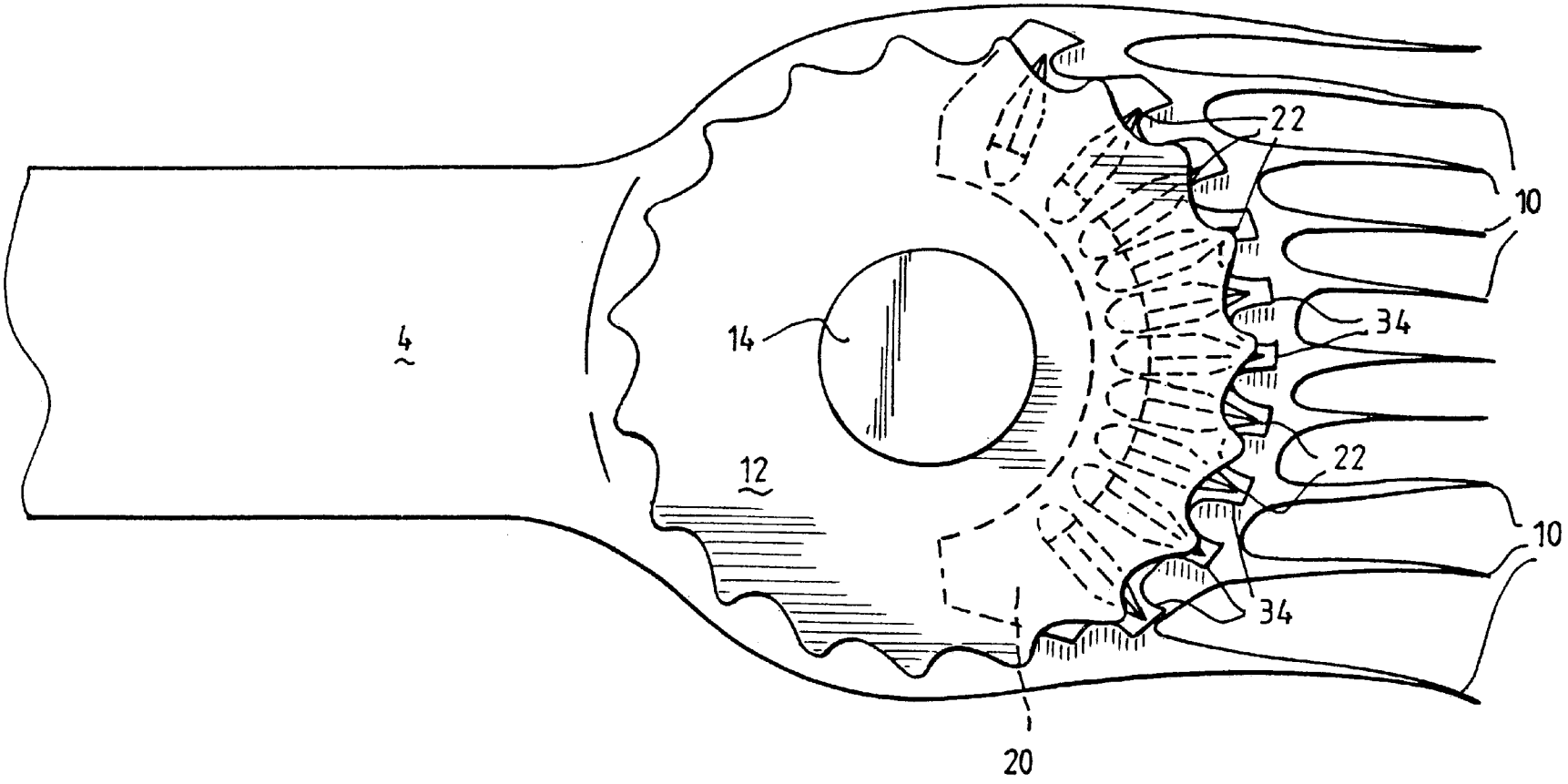
FIG. 3 shows the underside of the front portion of the rotary handpiece of FIG. 1.

FIG. 3 shows the underside of the handpiece of FIG. 1 The drawing shows part of the handle 4 and the generally circular body 8, which comprises integral guide leans consisting of fingers 10 in substantially parallel arrangement for guiding the handpiece across for example, a fleece. Attached to the body is the cartridge 20 in which is located the plurality of cutting elements 22 in the form of V-shaped chips. The blade retainer plate 14 is tightened to the hub axle thus retaining the blade in place and applying tension to the blade and cutting chips.

Each cutting element 22 of the cartridge 20 is located adjacent a projection 34 on the body portion of the cartridge; each projection in turn is located adjacent a finger of the body of the rotary handpiece. The cutting elements 22 are located such that one face or edge of the cutting chip is adjacent the cutting surface of cutting means 12 as it rotates.

In use of the handpiece of the present invention, the position of blade retainer plate 14 is adjusted with respect to the spindle 26 by whatever suitable means is provided, such as for example by a specially designed tool or by hand. A few test cuts of the material are made to determine whether further adjustment is required. If the gap between the teeth of rotary blade 12 and the cutting chips 22 is too great for effective and efficient cutting of the material, blade retainer plate 14 is further tightened onto the spindle so as to increase the tension by further compressing oaring 32 to bring rotary blade 12 closer to chips 22, thereby decreasing the gap therebetween. In this position, finer material can be cut. If the initial gap between rotary-blade and chips is too small, blade retainer plate 14 can be loosened to increase the gap by reducing the tension applied to the rotary blade. Thus, by altering the position of blade retainer plate 14, the tension applied to rotary blade 12 can be changed, thereby changing the force with which rotary blade 12 contacts chips 22, which in turn alters the cutting characteristics of the handpiece in accordance with the requirements for efficient and effective cutting of the actual material being cut by the handpiece.

Advantages of the present invention include the following:

the adjustment device of the present invention allows the blade to float in operation and the tension applied to the blade to be adjusted in accordance with the end use and/or conditions to which the handpiece is subjected;

the adjustment device allows adjustment o:E the tension applied to the rotating blade to compensate for uneven blades which are not perfectly planar such as bent or crooked blades, difficult shearing conditions, worn or damaged chips or blades, and to compensate for wear without the need to prematurely replace the blade or chips including the cartridge.

The described arrangement has been advanced by explanation and many modifications may be made without departing from the spirit and scope of the invention which includes every novel feature and novel combination of features hereindisclosed.

Those skilled in the art will appreciate that the invention described herein is susceptible to variations and modifications other than those specifically described. It is understood that the invention includes all such variations and codifications which fall within the spirit and scope.

What is claimed is:

1. A rotary handpiece suitable for cutting or severing a material comprising:

a cutting member capable of rotary motion in first plane of movement, at least one cutting element capable of linear movement in a second plane of movement, said first plane of movement being arranged substantially transversely to the second plane of movement, said first and second planes of movement intersecting with each other at a point where the cutting member contacts the at least one cutting element;

a handpiece body;

a first spindle mounted in the handpiece body; and a second spindle which engages the first spindle;

the first spindle, the cutting member and the second spindle being capable of rotating together relative to the handpiece body in the first plane of movement; the second spindle being movable relative to the first spindle to move the second spindle and the cutting member relative to the first spindle in a direction perpendicular to the first plane of movement, for applying tension to the cutting member to alter cutting characteristics of the handpiece, whereby the amount of clearance and the amount of contact between the cutting member and the cutting element is changed in order to alter the cutting characteristics of the handpiece to enable the handpiece to cut a wider range of material, wherein when said cutting member rotates in use, part of the cutting member contacts the cutting element to cut material located between the cutting member and the cutting element.

2. A handpiece according to claim 1, further comprising a plurality of similar cutting elements and wherein the rotary cutting member comes into contact with each of the cutting elements in turn as the rotary cutting element rotates to sever material located between the cutting member and each respective cutting element.

3. A handpiece according to claim 2, in which the plurality of cutting elements are mounted for movement within recesses provided in a replaceable cartridge locatable within the handpiece.

4. A method of adjusting the tension applied to a cutting handpiece according to claim 3, comprising the steps of making a test cut and manually adjusting the tensioning means.

5. A handpiece according to claim 1, further comprising a guide means in the form of a plurality of fingers extending outwardly from the handpiece, said fingers being arranged to guide material to be cut into contact with the cutting member and cutting elements wherein the cutting elements are associated with the fingers.

6. A method of adjusting the tension applied to a cutting handpiece according to claim 5, comprising the steps of making a test cut and manually adjusting the tensioning means.

7. A method of adjusting the tension applied to a cutting handpiece according to claim 2, comprising the steps of making a test cut and manually adjusting the tensioning means.

8. A handpiece according to claim 1, in which operation of the adjustable tensioning means is effected by hand or manually with the aid of a tool.

9. A method of adjusting the tension applied to a cutting handpiece according to claim 8, comprising the steps of making a test cut and manually adjusting the tensioning means.

10. A handpiece according to claim 8, further comprising a flanged member, a bearing and a resilient means located between the flanged member and the bearing, such that movement of the second spindle relative to the first spindle causes the flanged member and bearing to move relative to each other.

11. A method of adjusting the tension applied to a cutting handpiece according to claim 10, comprising the steps of making a test cut and manually adjusting the tensioning means.

12. A handpiece according to claim 10, in which the resilient means is an O-ring.

13. A method of adjusting the tension applied to a cutting handpiece according to claim 12, comprising the steps of making a test cut and manually adjusting the tensioning means.

14. A handpiece according to claim 12, further comprising a retainer plate for retaining the cutting member in the handpiece.

15. A handpiece according to claim 14 in which movement of the retainer plate adjusts the tension of the handpiece.

16. A method of adjusting the tension applied to a cutting handpiece according to claim 15, comprising the steps of making a test cut and manually adjusting the tensioning means.

17. A method of adjusting the tension applied to a cutting handpiece according to claim 14, comprising the steps of making a test cut and manually adjusting the tensioning means.

18. A handpiece according to claim 14, charaterised in that the retainer plate is connected to the first spindle such that one end of the first spindle bears down on the flanged member which compresses the O-ring against the bearing.

19. A method of adjusting the tension applied to a cutting handpiece according to claim 18, comprising the steps of making a test cut and manually adjusting the tensioning means.

20. A handpiece according to claim 1, in which the first spindle and the second spindle for applying tension to the cutting member apply steplessly adjustable tension.

21. A method of adjusting the tension applied to a cutting handpiece according to claim 20, comprising the steps of making a test cut and manually adjusting the tensioning means.

22. A handpiece according to claim 1, in which the tension applied to the cutting member is adjusted incrementally in steps or quanta by using ratchet mechanism or by the provision of detents to alter the tension in a stepwise manner.

23. A method of adjusting the tension applied to a cutting handpiece according to any one of claims 1 to 15, comprising the steps of making a test cut and manually adjusting the tension applied to the cutting member.

24. A method of adjusting the tension applied to a cutting handpiece according to claim 22, comprising the steps of making a test cut and manually adjusting the tensioning means.

25. A tensioning means suitable for use in adjusting the tension of a rotary handpiece having a rotary cutting blade and a plurality of elongate cutting chips by applying tension to the rotary cutting blade, in which the tensioning means comprises a first spindle, a second spindle, a flanged member, a bearing and an O-ring, arranged so that the O-ring is located between the bearing and the flanged members the first spindle and the second spindle being capable of rotating together in a first plane of movement, the second spindle being movable relative to the first spindle in a direction perpendicular to the first plane of movement, whereby tension can be applied to a rotary cutting blade, such that operation of the tensioning means results in relative movement of the bearing and flanged member with respect to each other to alter the cutting characteristics of the handpiece by altering the size of the clearance gap between the rotary blade and the elongate cutting chips.

* * * * *